US009206010B2

(12) United States Patent
Shelhart et al.

(10) Patent No.: US 9,206,010 B2
(45) Date of Patent: Dec. 8, 2015

(54) CYCLING MEDIA SUPPORT FOR COMPILED SETS USING ONE MOTOR DIRECTION

(71) Applicant: XEROX Corporation, Norwalk, CT (US)

(72) Inventors: Timothy G. Shelhart, West Henrietta, NY (US); Aaron M. Moore, Fairport, NY (US); Samuel P. Sadtler, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 106 days.

(21) Appl. No.: 14/138,274

(22) Filed: Dec. 23, 2013

(65) Prior Publication Data

US 2015/0175377 A1 Jun. 25, 2015

(51) Int. Cl.

| | |
|---|---|
| ***B65H 31/34*** | (2006.01) |
| ***B65H 31/30*** | (2006.01) |
| ***B65H 29/52*** | (2006.01) |
| ***B65H 31/26*** | (2006.01) |
| ***B65H 39/00*** | (2006.01) |
| ***B42C 1/12*** | (2006.01) |
| ***B65H 37/04*** | (2006.01) |

(52) U.S. Cl.

CPC ..... *B65H 31/3009* (2013.01); *B42C 1/12* (2013.01); *B65H 29/52* (2013.01); *B65H 31/26* (2013.01); *B65H 31/30* (2013.01); *B65H 31/3018* (2013.01); *B65H 31/34* (2013.01); *B65H 37/04* (2013.01); *B65H 39/00* (2013.01); *B65H 2801/27* (2013.01)

(58) Field of Classification Search

CPC .... B65H 37/04; B65H 31/30; B65H 31/3009; B65H 31/3018; B65H 2801/27

USPC ..... 270/58.08, 58.11; 271/213, 220

See application file for complete search history.

(56) References Cited

U.S. PATENT DOCUMENTS

| | | | | |
|---|---|---|---|---|
| 5,346,203 | A | 9/1994 | Stemmle | |
| 5,348,279 | A | 9/1994 | Lambregts et al. | |
| 5,609,333 | A | 3/1997 | Mandel et al. | |
| 5,649,695 | A | 7/1997 | Lawrence | |
| 6,330,999 | B2 | 12/2001 | Coombs et al. | |
| 6,443,450 | B1 | 9/2002 | Antinora | |
| 6,450,492 | B1 * | 9/2002 | Coombs et al. | 270/58.08 |
| 6,561,709 | B2 | 5/2003 | McVeigh et al. | |
| 6,722,650 | B1 * | 4/2004 | Abbata et al. | 271/213 |
| 6,776,404 | B1 * | 8/2004 | Milillo et al. | 270/58.18 |
| 6,814,350 | B2 * | 11/2004 | Saegusa et al. | 270/58.14 |
| 6,819,906 | B1 | 11/2004 | Herrmann et al. | |

(Continued)

*Primary Examiner* — Leslie A Nicholson, III

(74) *Attorney, Agent, or Firm* — Gibb & Riley, LLC

(57) ABSTRACT

A sheet-receiving surface comprises retractable bars movable between a first position and a second position. The first position is a first distance away from a mounting support. The second position is a second distance away from the mounting support. The first distance is greater than the second distance. Pivot arms, having a first end and a second end opposite the first end, are rotationally attached at the first end to the retractable bars and rotationally attached at the second end to the mounting support. Bias elements, operatively connected to the pivot arms, bias the retractable bars to the first position. A link is operatively connected to the retractable bars and an actuator. The sheet-receiving surface accumulates sheets of media into sets of sheets. Responsive to operation of the actuator, the link applies a force to move the retractable bars to the second position, forming an opening to allow the sets of sheets to drop, forming a stack of sets of sheets.

20 Claims, 8 Drawing Sheets

(56) References Cited

U.S. PATENT DOCUMENTS

| | | | | |
|---|---|---|---|---|
| 6,908,079 | B2 | 6/2005 | Milillo et al. | |
| 7,177,588 | B2 | 2/2007 | Terao et al. | |
| 7,448,615 | B2 | 11/2008 | Takamura | |
| 7,624,975 | B2 | 12/2009 | Reeves et al. | |
| 7,802,788 | B2 * | 9/2010 | Terao et al. | 271/189 |
| 8,052,134 | B2 * | 11/2011 | Terao et al. | 270/58.02 |
| 8,517,368 | B1 | 8/2013 | Brundige et al. | |

* cited by examiner

CYCLING MEDIA SUPPORT FOR COMPILED SETS USING ONE MOTOR DIRECTION

BACKGROUND

Devices and methods herein generally relate to machines such as printers and/or copier devices and, more particularly, to a retractable media support device.

As paper is fed into the stapler module of a document-finishing device, the media is compiled with the lead edges inside the throat of dual staplers. The trail edges of the media are supported by previously stapled sets in a completed stack. In order to permit set ejection from the throat of the stapler, the top of the stack is set several millimeters below the height of the compiled stack. This results in the compiled sheets taking on a bent/curved shape. Furthermore, this offset condition causes the compiled sheets to 'walk' backwards, away from the registration wall aligned with the stapler, which contributes to poor set registration. This is made worse as staple build-up accumulates, increasing the amount of offset with which the media should comply.

When stapled sets are ejected from the stapler, they are typically directed across the stack of previously stapled sets. This results in random and large shifts to the top stack set, creating very poor stack registration.

SUMMARY

Disclosed herein is a temporary support for sheets compiled at the stapler level of a printer device, preventing gross set shape changes and resulting forces acting on the compiled set. The temporary support is provided by retractable support bars that cycle between an extended position and a retracted position. The support bars are linked together under control of a unidirectional actuator. The links are driven with a crank drive, enabling the actuator to always run in the same direction. The links pull the support bars to a retracted position and spring-loaded biasing elements return the support bars to an extended position. The apparatus provides low inertia to permit fast response time. Additional features include:

- Relative motion between support bars and paper is mostly linear and symmetrically opposed providing better chance for stack quality
- Cabling permits in/out cycles without motor reversal enabling faster cycling and less chance of missed steps
- Low mass and simplicity provides optimal response time.

According to an apparatus herein, a sheet-receiving surface receives sheets of media. The sheet-receiving surface comprises retractable bars movable between a first position and a second position. The first position is a first distance away from a mounting support. The second position is a second distance away from the mounting support. The first distance is greater than the second distance. The apparatus includes pivot arms that have a first end and a second end opposite the first end. The pivot arms are rotationally attached at the first end to the retractable bars and rotationally attached at the second end to the mounting support. Bias elements are operatively connected to the pivot arms at the second end. The bias elements bias the retractable bars to the first position. A link is operatively connected to the retractable bars. An actuator is operatively connected to the link. In the first position, the sheet-receiving surface is positioned in a first plane to receive the sheets of media from a sheet transport assembly. The sheet-receiving surface accumulates the sheets of media into sets of sheets. Responsive to operation of the actuator, the link applies a force to the retractable bars. The retractable bars are moved to the second position. In the second position, the retractable bars form an opening to allow the sets of sheets to drop into a second plane, forming a stack of sets of sheets. The first plane is other than coplanar with the second plane and the first plane is relatively above the second plane.

According to a printing device herein, a print engine is operatively connected to a processor. A sheet transport assembly transports sheets of media from the print engine along a sheet processing direction. A sheet-receiving surface receives the sheets of media from the sheet transport assembly. The sheet-receiving surface comprises a first pair of retractable support bars and a second pair of retractable support bars. Each pair of retractable support bars is movable between an extended position and a retracted position. The extended position is a first distance away from a mounting support. The retracted position is a second distance away from the mounting support. The first distance is greater than the second distance. Each pair of retractable support bars comprises an inboard member and an outboard member. The inboard member is nearer the mounting support than the outboard member. The sheet-receiving surface includes a first set of pivot arms. Each arm of the first set of pivot arms has a first end and a second end opposite the first end. The first set of pivot arms is rotationally attached at the first end to an inboard member of each pair of retractable support bars and rotationally attached at the second end to the mounting support. The sheet-receiving surface includes a second set of pivot arms. Each arm of the second set of pivot arms has a first end and a second end opposite the first end. The second set of pivot arms is rotationally attached at the first end to an outboard member of each pair of retractable support bars and rotationally attached at the second end to the inboard member of each pair of retractable support bars. Bias elements are operatively connected to the second end of the pivot arms. The bias elements bias the retractable support bars to the extended position. The printing device includes a drive mechanism comprising a link operatively connected to the retractable support bars and an actuator operatively connected to the link and operatively connected to the processor. The actuator operates in a single direction. In the extended position, the retractable support bars are positioned in a first plane adjacent to each other. Each of the retractable support bars has a coplanar surface confronting the transport assembly. The sheet-receiving surface accumulates the sheets of media into sets of sheets. The processor controls operation of the actuator. A first operation of the actuator applies a force to the link, moving the retractable support bars to the retracted position. In the retracted position, the retractable support bars form an opening to allow the sets of sheets to drop into a second plane, forming a stack of sets of sheets. The first plane is other than coplanar with the second plane and the first plane is relatively above the second plane. A second operation of the actuator removes the force from the link. The bias elements move the retractable support bars to the extended position.

According to a method herein, a binding device is provided. A sheet-receiving surface is provided adjacent the binding device. The sheet-receiving surface comprises retractable bars movable between an extended position and a retracted position. The extended position is a first distance away from a mounting support. The retracted position is a second distance away from the mounting support. The first distance is greater than the second distance. Print media sheets are received from an image output device onto the sheet-receiving surface with the retractable bars in the extended position. The retractable bars are positioned in a first plane adjacent each other. Each of the retractable bars has a coplanar surface at a height to deliver the print media sheets to the binding device. A stack of the print media sheets is compiled on the sheet-receiving surface. The stack of the print media sheets is moved at least partially into an input opening of the binding device. A binding operation is performed on the stack of the print media sheets. The stack of the print media sheets is removed from the binding device. The retractable bars are retracted to the retracted position, forming an opening to allow the stack of the print media sheets to drop into a second plane, forming a finished stack of the print media sheets. The first plane is other than coplanar with the second plane and the first plane is relatively above the second plane.

These and other features are described in, or are apparent from, the following detailed description.

BRIEF DESCRIPTION OF THE DRAWINGS

Various examples of the devices and methods are described in detail below, with reference to the attached drawing figures, which are not necessarily drawn to scale and in which.

DETAILED DESCRIPTION

Figure 1:
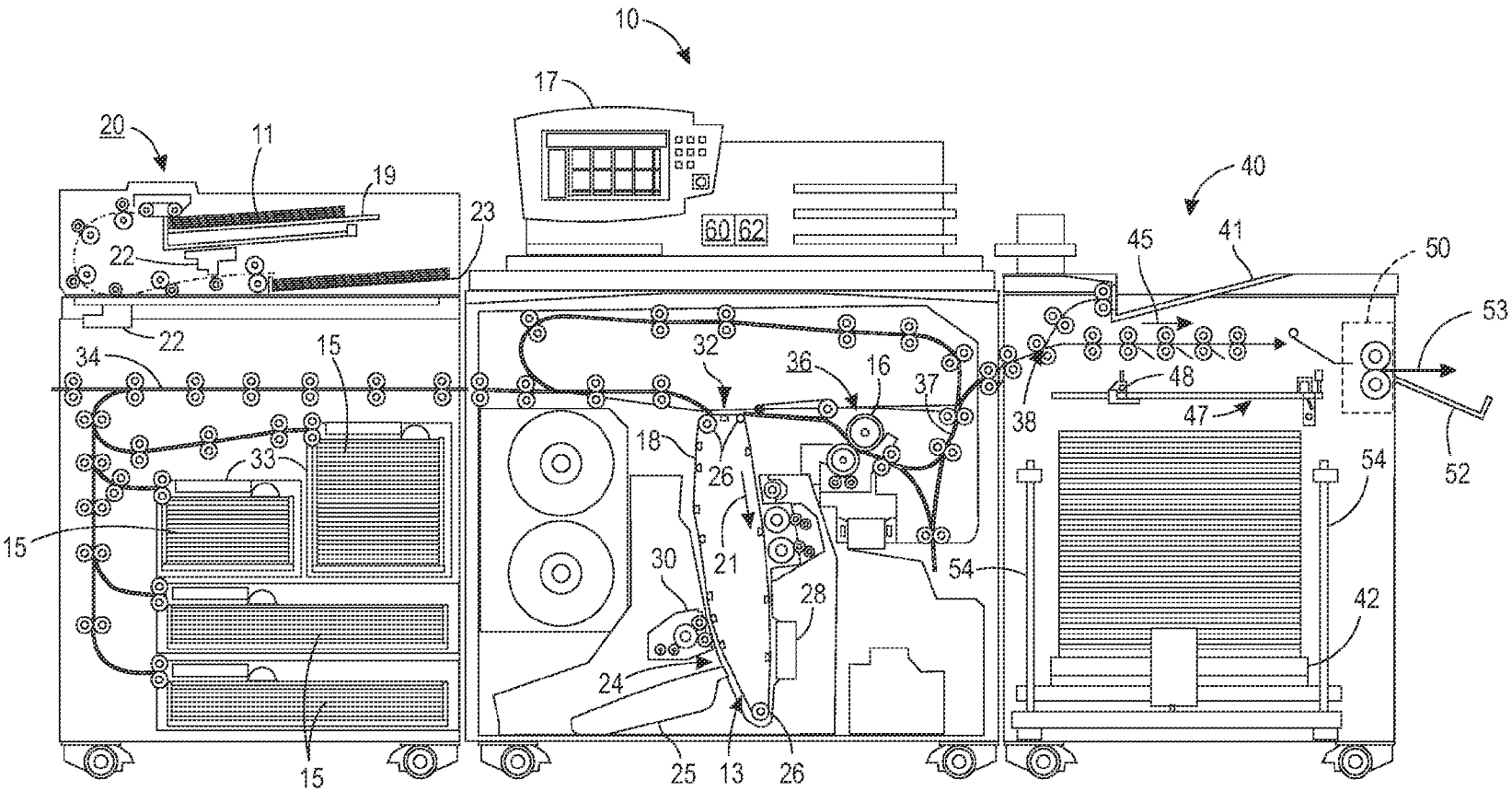
FIG. 1 is a side-view schematic diagram of a multi-function device according to devices and methods herein.

The disclosure will now be described by reference to a printing apparatus that includes a device for collecting and aligning a stack of sheets of a printing device in a media sheet tray of the printer. While the disclosure will be described hereinafter in connection with specific devices and methods thereof, it will be understood that limiting the disclosure to such specific devices and methods is not intended. On the contrary, it is intended to cover all alternatives, modifications, and equivalents as may be included within the spirit and scope of the disclosure as defined by the appended claims.

For a general understanding of the features of the disclosure, reference is made to the drawings. In the drawings, like reference numerals have been used throughout to identify identical elements.

According to devices and methods herein, a printing device uses helically formed rotating brushes to nudge printed sheets into a prepositioned registration corner. The rotation of the helical brush moves the sheet downward to the stacked position. The brush action gently moves the sheets toward two edge registration surfaces. As the stack grows higher, the brushes keep the stack registered against the edge guides. Brush rotation speed, bristle stiffness, and interference with the sheet can be adjusted to optimize performance.

Referring to the drawings, FIG. 1 shows a printing device 10, which can be used with devices and methods herein and can comprise, for example, a printer, copier, multi-function machine, multi-function device (MFD), etc. The printing device 10 may include an automatic document feeder 20 (ADF) that can be used to scan original documents 11 at a scanning station 22. The original documents 11 are fed from a first tray 19 to a second tray 23. The user may enter the desired printing and finishing instructions through a graphic user interface (GUI) or control panel 17, or use a job ticket, an electronic print job description from a remote source, etc. The GUI or control panel 17 can include one or more processors 60, power supplies, as well as storage devices 62 storing programs of instructions that are readable by the one or more processors 60 for performing the various functions described herein. The storage devices 62 can comprise, for example, non-volatile storage mediums including magnetic devices, optical devices, capacitor-based devices, etc.

An electronic or optical image or an image of an original document or set of documents to be reproduced may be projected or scanned onto a charged surface 13 or a photoreceptor belt 18 to form an electrostatic latent image. The photoreceptor belt 18 is mounted on a set of rollers 26. At least one of the rollers 26 is driven to move the photoreceptor belt 18 in the direction indicated by arrow 21 past the various other known electrostatic processing stations, including a charging station 28, imaging station 24 (for a raster scan laser system 25), developing station 30, and transfer station 32.

Thus, the latent image is developed with developing material to form a toner image corresponding to the latent image. More specifically, a sheet of print media 15 is fed from a selected media sheet tray 33 having a supply of paper to a sheet transport 34 for travel to the transfer station 32. There, the toned image is electrostatically transferred to the print media 15, to which it may be permanently fixed by a fusing device 16. The sheet is stripped from the photoreceptor belt 18 and conveyed to a fusing station 36 having fusing device 16 where the toner image is fused to the sheet. A guide can be applied to the print media 15 to lead it away from the fuser roll. After separating from the fuser roll, the print media 15 is then transported by a sheet output transport 37 to output trays in a multi-functional finishing station 40.

Printed sheets from the printing device 10 can be accepted at an entry port of the sheet transport assembly 38 and directed to multiple paths and output trays for printed sheets, such as top tray 41 and collection tray 42 for storing finished sets of sheets, corresponding to different desired actions, such as stapling, hole-punching, and C or Z-folding. The sheet transport assembly 38 receives and transports the print media 15 from the printing device 10 along a paper path indicated by arrow 45.

According to devices and methods herein, the multi-functional finishing station 40 can also include a sheet support apparatus, indicated generally as 47, located above the collection tray 42. Sheets are stacked and compiled into sets on the sheet support apparatus 47. A tamper device or clamp 48 moves the stack of the print media sheets at least partially into an input opening of the binding station 50 and then each set of sheets may be stapled or bound at the binding station 50. Finished set of sheets may be ejected from the binding station 50 into pick-up tray 52, as indicated by arrow 53, or the finished set of sheets may be returned to a location on the sheet support apparatus 47. As described in further detail below, the sheet support apparatus 47 can then be operated to allow the finished set of sheets to be dropped onto the collection tray 42. The collection tray 42 may be vertically movable by, for example, vertical screws 54 at each corner of the collection tray 42.

It is to be understood that various rollers and other devices that contact and handle sheets within the multi-functional finishing station 40 are driven by various motors, solenoids, and other electromechanical devices (not shown), under a control system, such as including the processor 60 of the GUI or control panel 17 or elsewhere, in a manner generally familiar in the art. The processor 60 may comprise a microprocessor.

Thus, the multi-functional finishing station 40 described herein, has a top tray 41 and a collection tray 42. Those ordinarily skilled in the art would understand that the multi-functional finishing station 40 could comprise any functional unit, such as, for example, a modular booklet maker and/or a folding and booklet making station that adds stapled and unstapled booklet making, and single sheet C-fold and Z-fold capabilities. The top tray 41 may be used as a purge destination, as well as, a destination for the simplest of jobs that require no finishing and no collated stacking. The sheet support apparatus 47 may be positioned at a height to deliver one or more sheets of the print media 15 to an input opening of the binding station 50 and is used for most jobs that require stacking or stapling. The collection tray 42 may be used to produce signature booklets, saddle stitched or not, and tri-folded. Finished booklets may be collected in a stacker or other appropriate output device. Sheets that are not to be C-folded, Z-folded, or made into booklets or that do not require stapling are forwarded to top tray 41.

Figure 2:
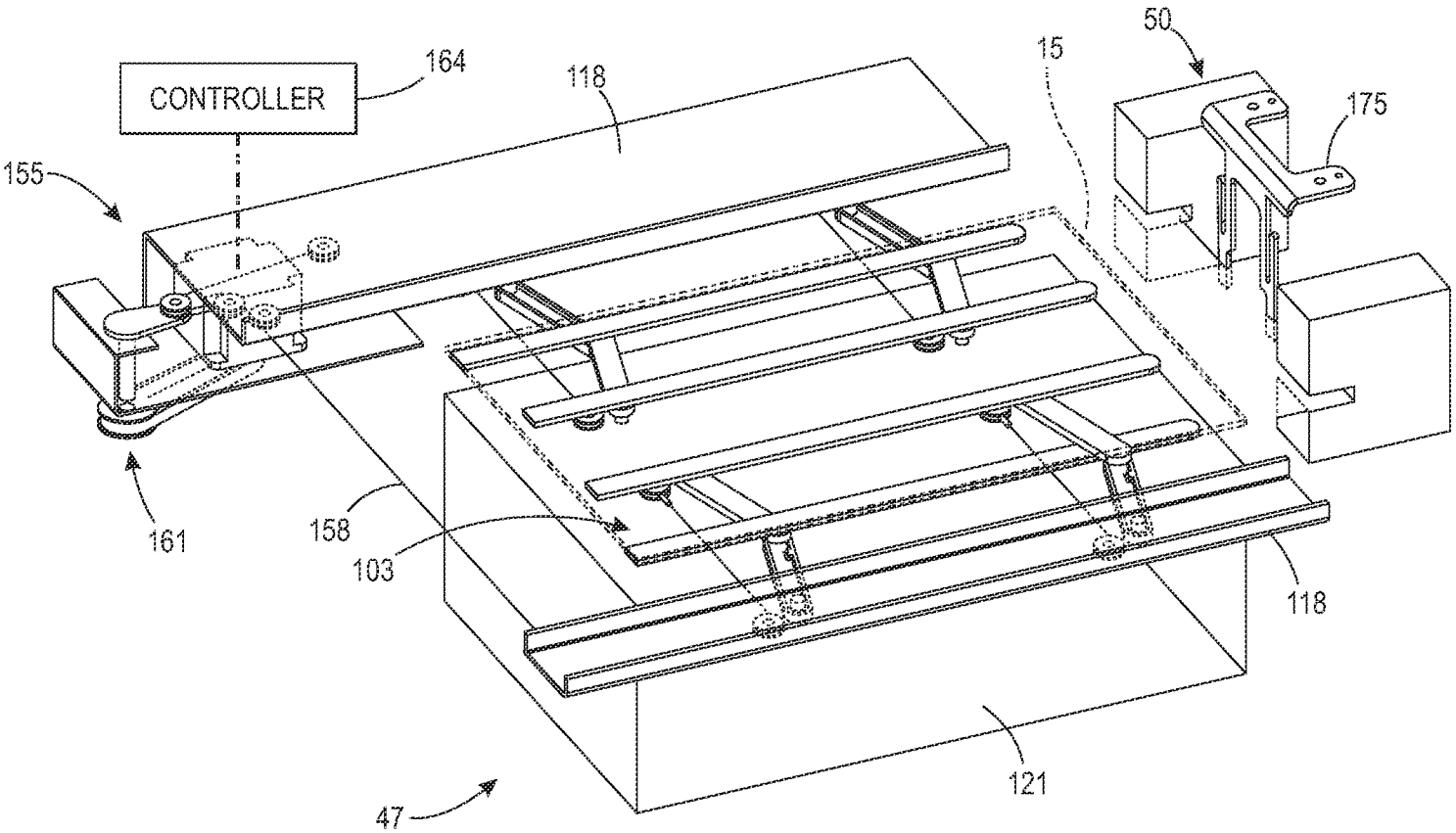
FIG. 2 is an isometric view of a sheet support apparatus according to devices and methods herein.
Figure 3:
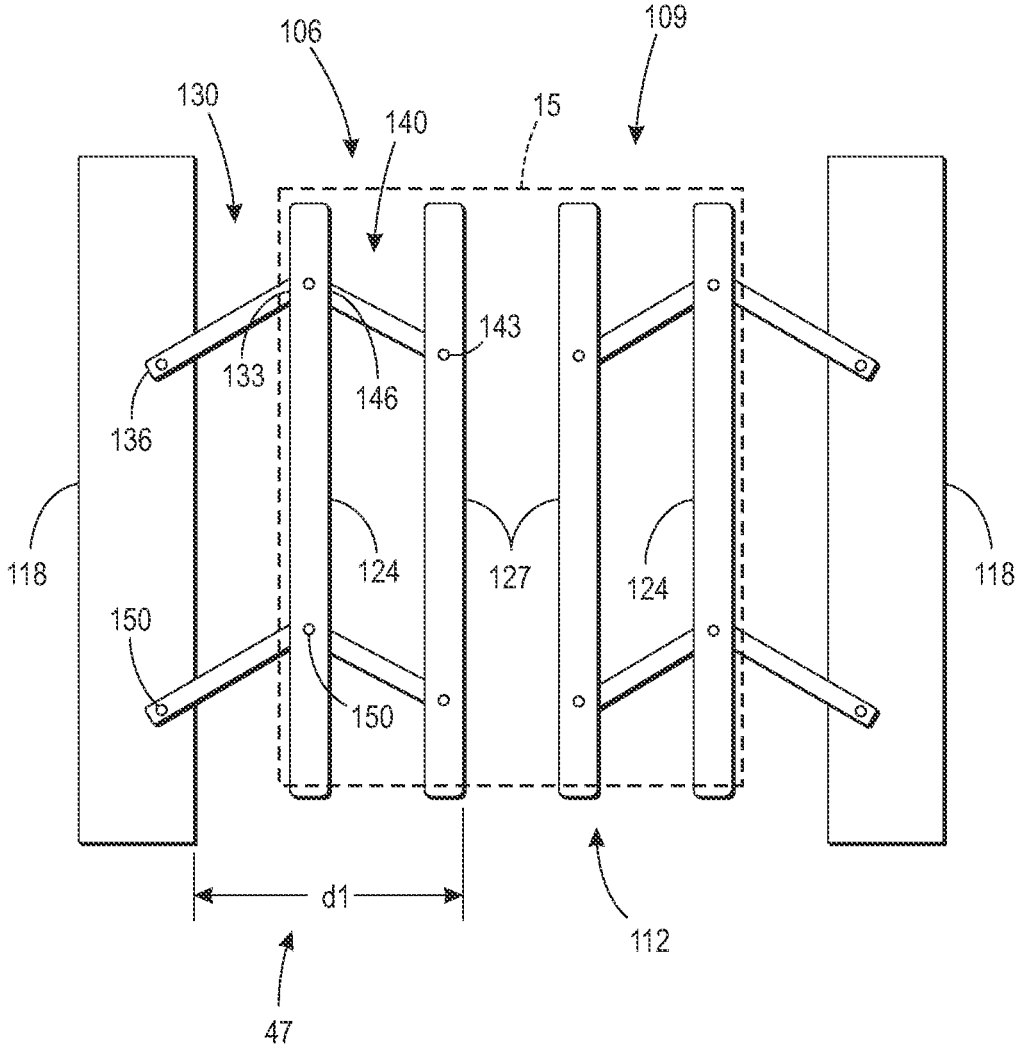
FIG. 3 is a top plan view of a sheet support apparatus according to devices and methods herein.
Figure 4:
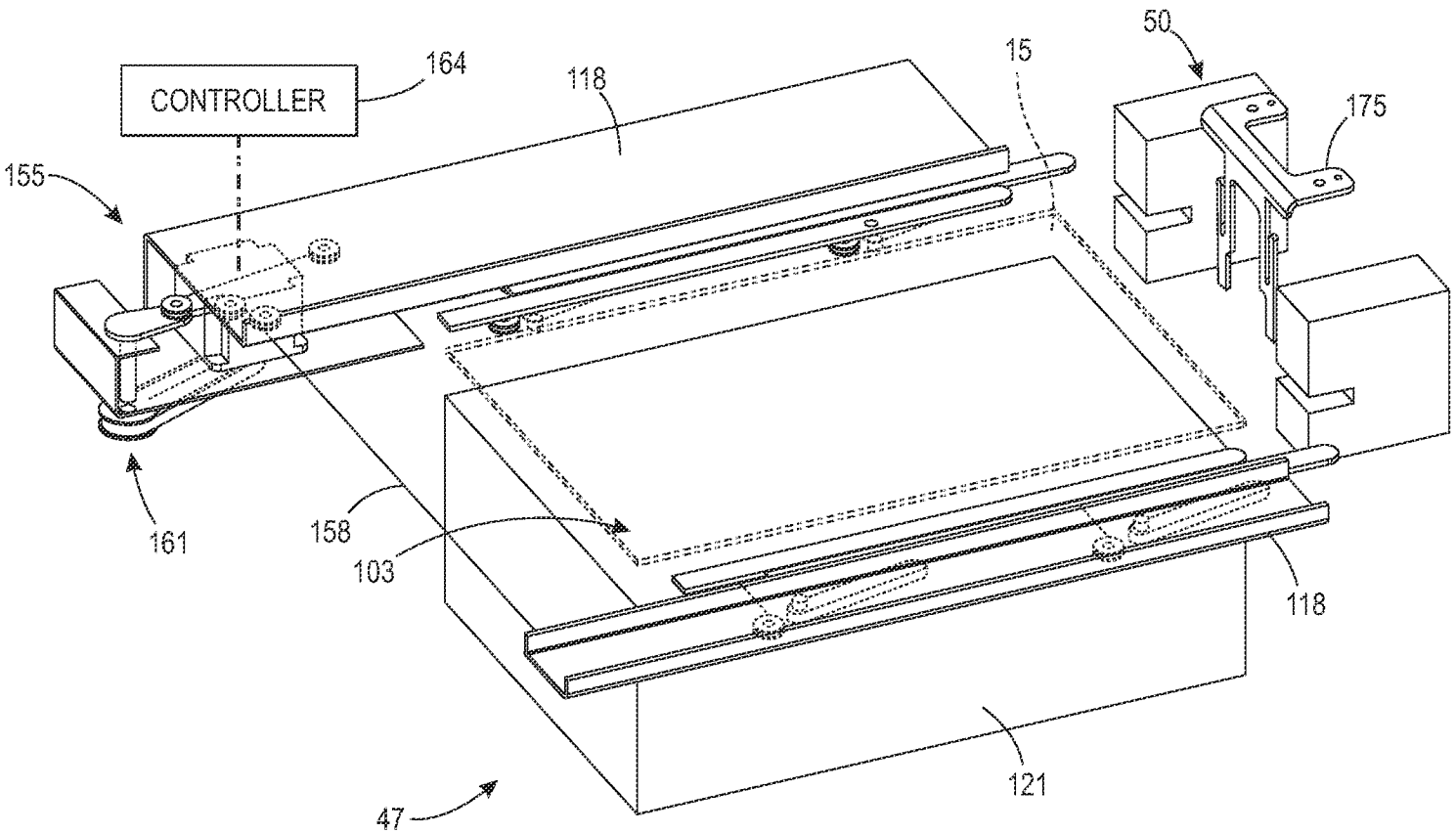
FIG. 4 is an isometric view of a sheet support apparatus according to devices and methods herein.
Figure 5:
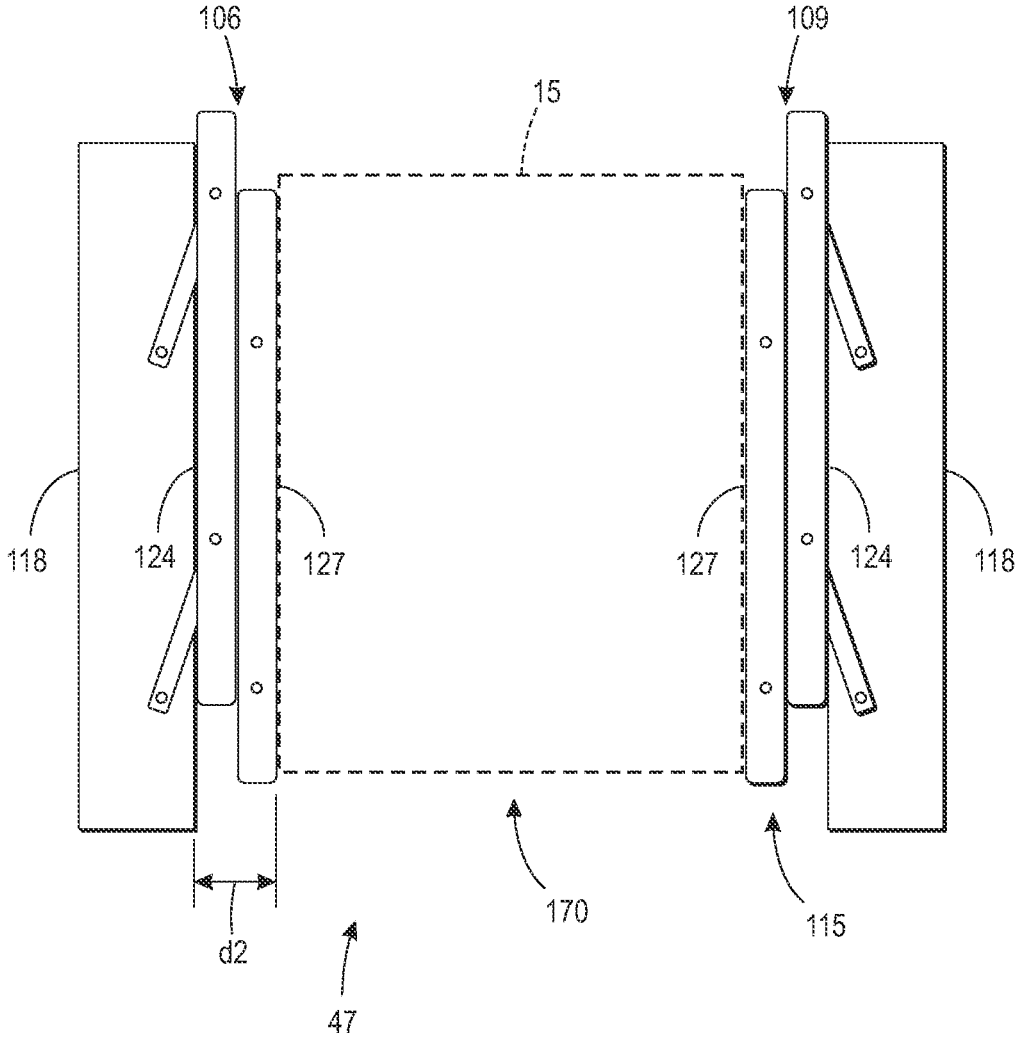
FIG. 5 is a top plan view of a sheet support apparatus according to devices and methods herein.

FIG. 2 shows an isometric view of a sheet support apparatus 47 according to devices and methods herein. The sheet support apparatus 47 creates a sheet-receiving surface 103 for one or more sheets of print media 15. The sheet-receiving surface 103 includes a first pair of retractable support bars 106 and a second pair of retractable support bars 109. Each of the pairs of retractable support bars 106, 109 is movable between an extended position 112 (best seen in FIG. 3) and a retracted position 115 (best seen in FIG. 5). The extended position 112 is a first distance d1 away from a mounting support 118, shown in FIG. 3. The retracted position 115 is a second distance d2 away from the mounting support 118, shown in FIG. 5. The first distance d1 is greater than the second distance d2. In the extended position 112, the retractable support bars 106, 109 are positioned at a location to receive sheets of the print media 15 from the sheet transport assembly 38 at a height to deliver the sheets of the print media 15 to an input opening of the binding station 50. In the retracted position 115, the retractable support bars 106, 109 are positioned to allow the sheets of the print media 15 to drop into a stack 121, as shown in FIG. 4.

Each pair of retractable support bars 106, 109 comprises an inboard member 124 and an outboard member 127. The inboard member 124 is nearer the mounting support 118 than the outboard member 127. The sheet support apparatus 47 may include a first set of pivot arms 130. Each arm of the first set of pivot arms 130 has a first end 133 and a second end 136 opposite the first end 133. The first set of pivot arms 130 is rotationally attached at the first end 133 to an inboard member 124 of each pair of retractable support bars 106, 109 and rotationally attached at the second end 136 to the mounting support 118. The sheet support apparatus 47 may include a second set of pivot arms 140. Each arm of the second set of pivot arms 140 has a first end 143 and a second end 146 opposite the first end 143. The second set of pivot arms 140 is rotationally attached at the first end 143 to an outboard member 127 of each pair of retractable support bars 106, 109 and rotationally attached at the second end 146 to the inboard member 124 of each pair of retractable support bars 106, 109.

Bias elements 150 are operatively connected to the second end 136, 146 of the pivot arms. According to devices and methods herein, the bias elements 150 may comprise springs, bands, gas pistons, arched elements, or other similar elements as would be known by one skilled in the art. The bias elements 150 bias the retractable support bars 106, 109 to the extended position 112.

The printing device 10 includes a drive mechanism 155 comprising a link 158 operatively connected to the retractable support bars 106, 109 and an actuator 161 operatively connected to the link 158 and operatively connected to a controller 164. The controller 164 may be part of the processor 60 of the printing device 10. The controller 164 controls operation of the actuator 161. According to devices and methods herein, the actuator 161 may be pneumatic, hydraulic, electric, or other similar devices as would be known by one ordinarily skilled in the art. In some examples, the actuator operates in a single direction. Additionally, the link 158 may be any appropriate connector or similar device, which could be wire, string, cable, bands, gears, bars, poles, frame elements, etc. as would be known by one ordinarily skilled in the art.

The sheet-receiving surface 103 accumulates sheets of print media 15 from the sheet transport assembly 38 into sets of sheets. A first operation of the actuator 161 applies a force to the link 158, moving the retractable support bars 106, 109 to the retracted position 115. In the retracted position 115, the retractable support bars 106, 109 form an opening 170 to allow the sets of sheets to drop into the stack 121. A second operation of the actuator 161 removes the force from the link 158. The bias elements 150 move the retractable support bars 106, 109 to the extended position 112.

The retractable support bars 106, 109 are positioned in a first plane adjacent each other. Each of the retractable support bars 106, 109 has a coplanar surface at a height to deliver the sheets of print media 15 to the binding station 50. When the retractable support bars 106, 109 are retracted to the retracted position 115, the opening 170 allows the stack of the sheets of print media 15 to drop into a second plane, forming a finished stack 121 of the print media sheets. According to devices and methods herein, the first plane is other than coplanar with the second plane and the first plane is relatively above the second plane.

With the retractable support bars 106, 109 in the extended position 112, sheets of print media 15 are accumulated from the sheet transport assembly 38 into sets of sheets until a set is completed. The set of sheets is delivered into the stapler throat of the binding station. After stapling, the set of sheets is clamped and pushed out at the same level past the stack registration wall 175, avoiding relative motion with the completed set stack. The retractable support bars 106, 109 rapidly retract due to operation of the drive mechanism 155, allowing set of sheets to drop to finished stack 121 while set clamp is released. The retractable support bars 106, 109 rapidly extend by operation of the bias elements 150 to await the start of the next set of sheets.

According to a sheet support apparatus 47, a sheet-receiving surface 103 receives sheets of print media 15. The sheet-receiving surface 103 comprises retractable support bars 106, 109 movable between a first position and a second position. The first position is the extended position 112 and the second is the retracted position 115. The extended (first) position 112 is a first distance d1 away from a mounting support 118. The retracted (second) position 115 is a second distance d2 away from the mounting support 118. The first distance d1 is greater than the second distance d2. The sheet support apparatus 47 includes pivot arms 130, 140 that have a first end and a second end opposite the first end. The pivot arms 130, 140 are rotationally attached at the first end to the retractable support bars 106, 109 and rotationally attached at the second end to the mounting support 118. Bias elements 150 are operatively connected to the pivot arms 130, 140 at the second end. The bias elements 150 bias the retractable support bars 106, 109 to the first position. A link 158 is operatively connected to the retractable support bars 106, 109. An actuator 161 is operatively connected to the link 158. In the extended (first) position 112, the sheet-receiving surface 103 is positioned in a first plane to receive the sheets of media from the sheet transport assembly 38. The sheet-receiving surface 103 accumulates the sheets of media into sets of sheets. Responsive to operation of the actuator 161, the link 158 applies a force to the retractable support bars 106, 109. The retractable support bars 106, 109 are moved to the retracted (second) position 115. In the retracted (second) position 115, the retractable support bars 106, 109 form an opening 170 to allow the sets of sheets to drop into a second plane, forming a stack 121 of sets of sheets. The first plane is other than coplanar with the second plane and the first plane is relatively above the second plane.

Figure 6:
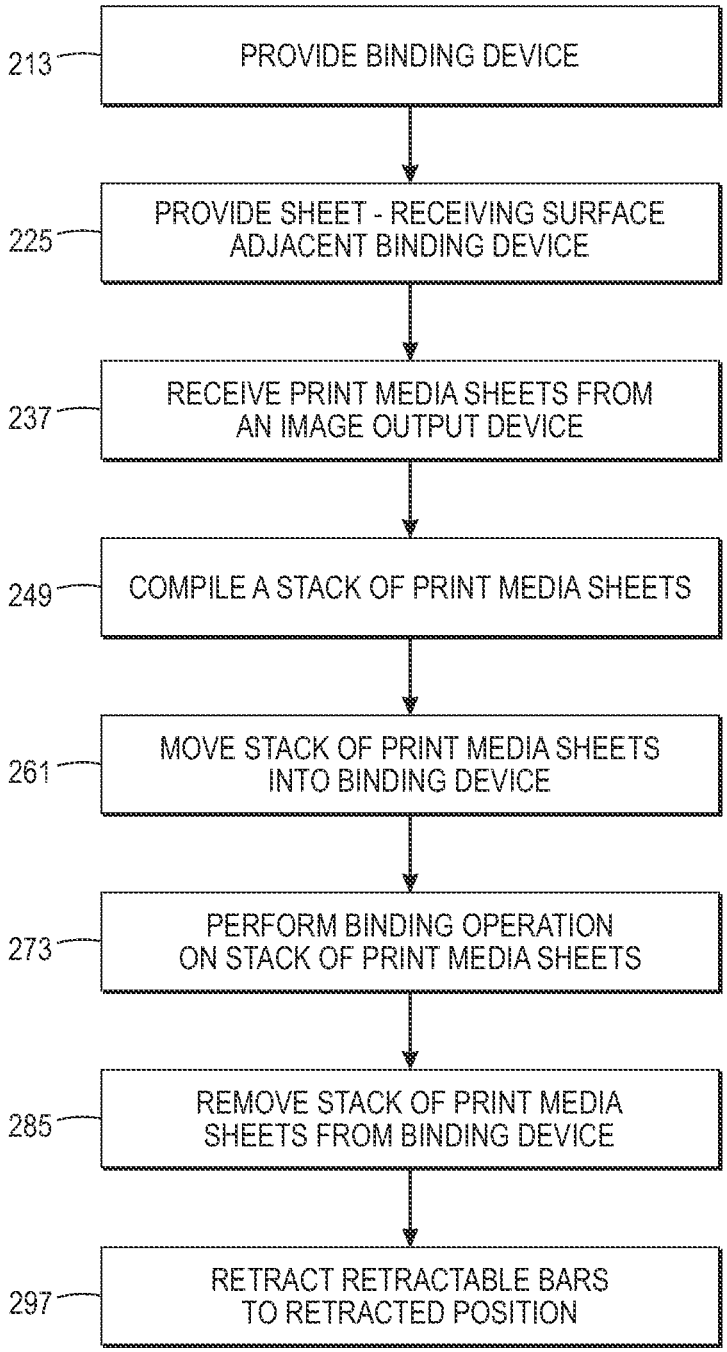
FIG. 6 is a flow diagram illustrating methods herein.

FIG. 6 is a flow diagram illustrating the processing flow of an exemplary method according to devices and methods herein. A binding device is provided, at 213. At 225, a sheet-receiving surface is provided adjacent the binding device. The sheet-receiving surface comprises retractable bars movable between an extended position and a retracted position. The extended position is a first distance away from a mounting support. The retracted position is a second distance away from the mounting support. The first distance is greater than the second distance. At 237, print media sheets are received from an image output device onto the sheet-receiving surface with the retractable bars in the extended position. The retractable bars are positioned in a first plane adjacent each other. Each of the retractable bars has a coplanar surface at a height to deliver the print media sheets to the binding device. At 249, a stack of the print media sheets is compiled on the sheet-receiving surface. At 261, the stack of the print media sheets is moved, at least partially, into an input opening of the binding device. At 273, a binding operation is performed on the stack of the print media sheets. At 285, the stack of the print media sheets is removed from the binding device. The retractable bars are retracted to the retracted position, at 297, forming an opening to allow the stack of the print media sheets to drop into a second plane, forming a finished stack of the print media sheets. The first plane is other than coplanar with the second plane and the first plane is relatively above the second plane.

Figure 7:
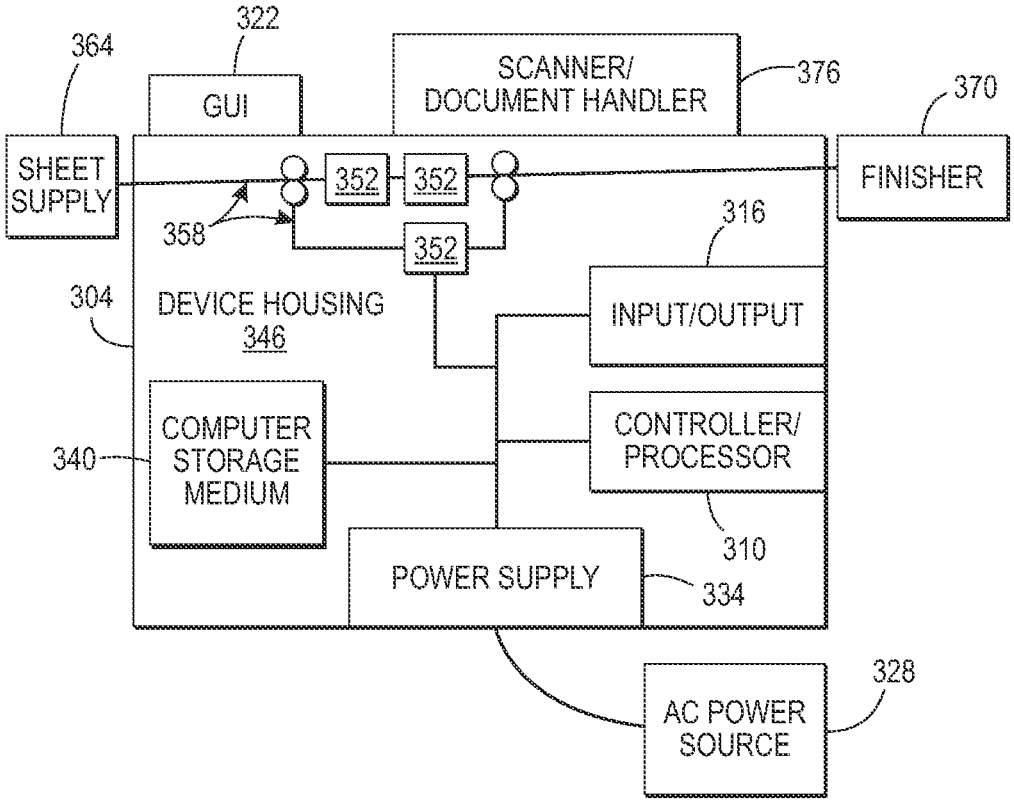
FIG. 7 is a block diagram of a multi-function device according to devices and methods herein.
Figure 8:
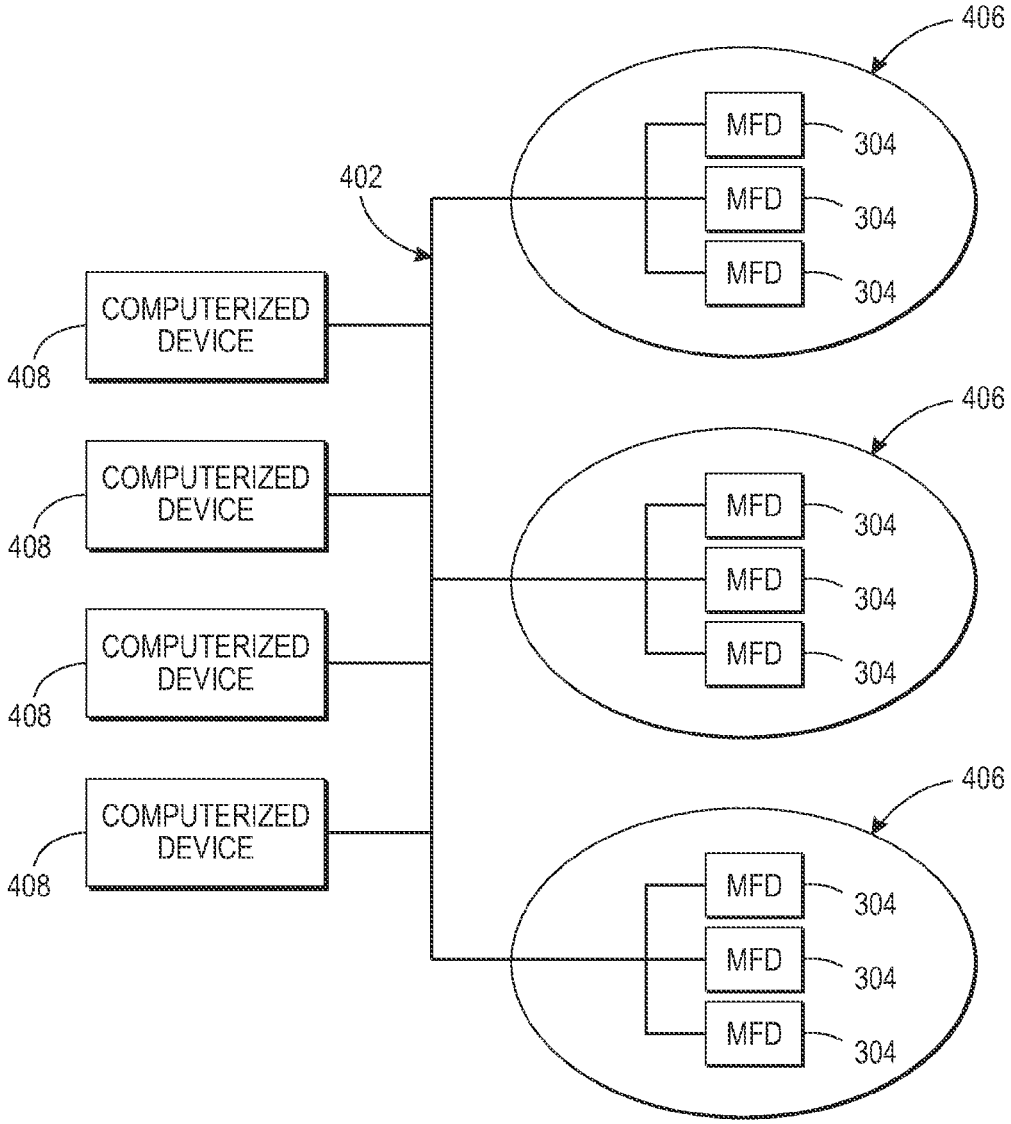
FIG. 8 is a schematic diagram illustrating devices and methods herein.

FIG. 7 illustrates a block diagram of a multi-function device 304 that can be used with devices and methods herein and can comprise, for example, a printer, copier, multi-function machine, etc. The multi-function device 304 includes a controller/processor 310 and a communications port (input/output) 316 operatively connected to the controller/processor 310 and to a network 402 external to the multi-function device 304, as shown in FIG. 8. In addition, the multi-function device 304 can include at least one accessory functional component, such as a graphic user interface (GUI) assembly 322 that operates on the power supplied from the AC power source 328, which may be external to the multi-function device 304. The AC power source 328 may provide electrical power through the power supply 334.

The controller/processor 310 controls the various actions of the multi-function device 304. A non-transitory computer storage medium device 340 (which can be optical, magnetic, capacitor based, etc.) is readable by the controller/processor 310 and stores instructions that the controller/processor 310 executes to allow the multi-function device 304 to perform its various functions, such as those described herein. Thus, as shown in FIG. 7, a device housing 346 has one or more functional components that operate on power supplied from the AC power source 328 by the power supply 334. The power supply 334 can comprise a power storage element (e.g., a battery) and connects to the AC power source 328, which may be external to the multi-function device 304. The power supply 334 converts the external power into the type of power needed by the various components.

The multi-function device 304 includes at least one marking device (print engines) 352 operatively connected to the controller/processor 310, a media path 358 positioned to supply sheets of media from a sheet supply 364 to the marking device(s) 352, etc. After receiving various markings from the printing engine(s), the sheets of media can optionally pass to a finisher 370, which can fold, staple, sort, etc., the various printed sheets. In addition, the multi-function device 304 can include at least one accessory functional component (such as a scanner/document handler 376, etc.) that also operates on the power supplied from the AC power source 328 (through the power supply 334).

As would be understood by those ordinarily skilled in the art, the multi-function device 304 shown in FIG. 7 is only one example, and the devices and methods herein are equally applicable to other types of printing devices that may include fewer components or more components. For example, while a limited number of printing engines and paper paths are illustrated in FIGS. 1 and 7, those ordinarily skilled in the art would understand that many more paper paths and additional printing engines could be included within any printing device used with devices and methods herein.

As shown in FIG. 8, exemplary printers, copiers, multi-function machines, and multi-function devices (MFD) 304 may be located at various different physical locations 406. Other devices according to devices and methods herein may include various computerized devices 408. The computerized devices 408 can include print servers, printing devices, personal computers, etc., and are in communication (operatively connected to one another) by way of a network 402. The network 402 may be any type of network, including a local area network (LAN), a wide area network (WAN), or a global computer network, such as the Internet.

Aspects of the present disclosure are described herein with reference to flowchart illustrations and/or block diagrams of methods, apparatus (systems), and computer program products according to various devices and methods. It will be understood that each block of the flowchart illustrations and/or two-dimensional block diagrams, and combinations of blocks in the flowchart illustrations and/or block diagrams, can be implemented by computer program instructions. The computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

According to a further device and method herein, an article of manufacture is provided that includes a tangible computer readable medium having computer readable instructions embodied therein for performing the steps of the computer implemented methods, including, but not limited to, the method illustrated in FIG. 6. Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. Any of these devices may have computer readable instructions for carrying out the steps of the methods described above with reference to FIG. 6.

The computer program instructions may be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

Furthermore, the computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

In case of implementing the devices and methods herein by software and/or firmware, a program constituting the software may be installed into a computer with dedicated hardware, from a storage medium or a network, and the computer is capable of performing various functions if with various programs installed therein.

In the case where the above-described series of processing is implemented with software, the program that constitutes the software may be installed from a network such as the Internet or a storage medium such as the removable medium. Examples of a removable medium include a magnetic disk (including a floppy disk), an optical disk (including a Compact Disk-Read Only Memory (CD-ROM) and a Digital Versatile Disk (DVD)), a magneto-optical disk (including a Mini-Disk (MD) (registered trademark)), and a semiconductor memory. Alternatively, the storage medium may be the ROM, a hard disk contained in the storage section of the disk units, or the like, which has the program stored therein and is distributed to the user together with the device that contains them.

As will be appreciated by one skilled in the art, aspects of the devices and methods herein may be embodied as a system, method, or computer program product. Accordingly, aspects of the present disclosure may take the form of an entirely hardware system, an entirely software system (including firmware, resident software, micro-code, etc.) or an system combining software and hardware aspects that may all generally be referred to herein as a "circuit," "module", or "system." Furthermore, aspects of the present disclosure may take the form of a computer program product embodied in one or more computer readable medium(s) having computer readable program code embodied thereon.

Any combination of one or more computer readable non-transitory medium(s) may be utilized. The computer readable medium may be a computer readable signal medium or a computer readable storage medium. The non-transitory computer storage medium stores instructions, and a processor executes the instructions to perform the methods described herein. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium include the following: an electrical connection having one or more wires, a portable computer diskette, a hard disk, a random access memory (RAM), a Read Only Memory (ROM), an Erasable Programmable Read Only Memory (EPROM or Flash memory), an optical fiber, a magnetic storage device, a portable compact disc Read Only Memory (CD-ROM), an optical storage device, a "plug-and-play" memory device, like a USB flash drive, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including, but not limited to, wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Smalltalk, C++, or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The flowchart and block diagrams in the figures illustrate the architecture, functionality, and operation of possible implementations of systems, methods, and computer program products according to various devices and methods herein. In this regard, each block in the flowchart or block diagrams may represent a module, segment, or portion of code, which comprises one or more executable instructions for implementing the specified logical function(s). It should also be noted that, in some alternative implementations, the functions noted in the block might occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Many computerized devices are discussed above. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well known by those ordinarily skilled in the art and are not described in detail herein to keep this disclosure focused on the salient features presented. The devices and methods herein can encompass devices that print in color, monochrome, or handle color or monochrome image data. All foregoing devices and methods are specifically applicable to electrostatographic and/or xerographic machines and/or processes.

The terminology used herein is for the purpose of describing particular devices and methods only and is not intended to be limiting of this disclosure. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

In addition, terms such as "right", "left", "vertical", "horizontal", "top", "bottom", "upper", "lower", "under", "below", "underlying", "over", "overlying", "parallel", "perpendicular", etc., used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms 'automated' or 'automatically' mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various devices and methods of the present disclosure have been presented for purposes of illustration, but are not intended to be exhaustive or limited to the devices and methods disclosed. Many modifications and variations will be apparent to those of ordinary skill in the art without departing from the scope and spirit of the described devices and methods. The terminology used herein was chosen to best explain the principles of the devices and methods, the practical application or technical improvement over technologies found in the marketplace, or to enable others of ordinary skill in the art to understand the devices and methods disclosed herein.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the devices and methods herein cannot be implied or imported from any above example as limitations to any particular order, number, position, size, shape, angle, color, or material.

What is claimed is:

1. An apparatus, comprising:

a sheet-receiving surface receiving sheets of media, said sheet-receiving surface comprising retractable bars movable between a first position and a second position, said first position being a first distance away from a mounting support, said second position being a second distance away from said mounting support, and said first distance being greater than said second distance, said retractable bars comprising a first pair of retractable bars and a second pair of retractable bars, each pair of retractable bars comprising an inboard member and an outboard member, said inboard member being nearer said mounting support than said outboard member;

a first set of pivot arms, each arm of said first set of pivot arms having a first end, and having a second end opposite said first end, each arm of said first set of pivot arms being rotationally attached at said first end to said inboard member of each of said pair of retractable bars and rotationally attached at said second end to said mounting support;

a second set of pivot arms, each arm of said second set of pivot arms having a first end, and having a second end opposite said first end, each arm of said second set of pivot arms being rotationally attached at said first end to said outboard member of each of said pair of retractable bars and rotationally attached at said second end to said inboard member of each of said pair of retractable bars;

bias elements operatively connected to each arm of said pivot arms at said second end, said bias elements biasing said retractable bars to said first position;

a link operatively connected to said retractable bars; and an actuator operatively connected to said link, in said first position, said sheet-receiving surface being positioned in a first plane to receive said sheets of media from a sheet transport assembly, said sheet-receiving surface accumulating said sheets of media into sets of sheets, responsive to operation of said actuator, said link applying a force to said retractable bars, moving said retractable bars to said second position, and in said second position, said retractable bars forming an opening to allow said sets of sheets to drop into a second plane, forming a stack of sets of sheets, said first plane being other than coplanar with said second plane and said first plane being relatively above said second plane.

2. The apparatus according to claim 1, said bias elements comprising one of:

springs, bands, gas pistons, and arched elements.

3. The apparatus according to claim 1, said link comprising one of:
wire,
string,
cable,
bands,
gears,
bars,
poles, and
frame elements.

4. The apparatus according to claim 1, said actuator comprising one of:
a pneumatic device,
an hydraulic device, and
an electric motor.

5. The apparatus according to claim 1, further comprising:
a binding device adjacent said sheet-receiving surface.

6. The apparatus according to claim 5, said binding device comprising a stapler.

7. The apparatus according to claim 1, further comprising:
a processor controlling operation of said actuator,
a first operation of said actuator applying a force to said link, moving said retractable bars to said second position, and
a second operation of said actuator removing said force from said link, said bias elements moving said retractable bars to said first position.

8. A printing device, comprising:
a processor;
a print engine operatively connected to said processor;
a sheet transport assembly transporting sheets of media from said print engine along a sheet processing direction;
a sheet-receiving surface receiving said sheets of media from said sheet transport assembly, said sheet-receiving surface comprising a first pair of retractable support bars and a second pair of retractable support bars, each said pair of retractable support bars being movable between an extended position and a retracted position,
said extended position being a first distance away from a mounting support,
said retracted position being a second distance away from said mounting support,
said first distance being greater than said second distance, and
each said pair of retractable support bars comprising an inboard member and an outboard member, said inboard member being nearer said mounting support than said outboard member;
a first set of pivot arms, each arm of said first set of pivot arms having a first end, and having a second end opposite said first end, said first set of pivot arms being rotationally attached at said first end to an inboard member of each of said pair of retractable support bars and rotationally attached at said second end to said mounting support;
a second set of pivot arms, each arm of said second set of pivot arms having a first end, and having a second end opposite said first end, said second set of pivot arms being rotationally attached at said first end to an outboard member of each of said pair of retractable support bars and rotationally attached at said second end to said inboard member of each of said pair of retractable support bars;
bias elements operatively connected to said second end of said pivot arms, said bias elements biasing said retractable support bars to said extended position; and
a drive mechanism comprising:
a link operatively connected to said retractable support bars; and
an actuator operatively connected to said link and operatively connected to said processor, said actuator operating in a single direction,
in said extended position, said retractable support bars being positioned in a first plane adjacent each other, each of said retractable support bars having a coplanar surface confronting said transport assembly,
said sheet-receiving surface accumulating said sheets of media into sets of sheets,
said processor controlling operation of said actuator,
a first operation of said actuator applying a force to said link, moving said retractable support bars to said retracted position, in said retracted position, said retractable support bars forming an opening to allow said sets of sheets to drop into a second plane, forming a stack of sets of sheets, said first plane being other than coplanar with said second plane and said first plane being relatively above said second plane, and
a second operation of said actuator removing said force from said link, said bias elements moving said retractable support bars to said extended position.

9. The printing device according to claim 8, said bias elements comprising one of:
springs,
bands,
gas pistons, and
arched elements.

10. The printing device according to claim 8, said link comprising one of:
wire,
string,
cable,
bands,
gears,
bars,
poles, and
frame elements.

11. The printing device according to claim 8, said actuator comprising one of:
a pneumatic device,
an hydraulic device, and
an electric motor.

12. The printing device according to claim 8, further comprising:
a binding device adjacent said sheet-receiving surface.

13. The printing device according to claim 12, said binding device comprising a stapler.

14. A method comprising:
providing a binding device,
providing a sheet-receiving surface adjacent said binding device, said sheet-receiving surface comprising retractable bars movable between an extended position and a retracted position,
said extended position being a first distance away from a mounting support,
said retracted position being a second distance away from said mounting support, and
said first distance being greater than said second distance,
said retractable bars comprising a first pair of retractable bars and a second pair of retractable bars, each pair of retractable bars comprising an inboard member and an outboard member, said inboard member being nearer said mounting support than said outboard member;

receiving print media sheets from an image output device onto said sheet-receiving surface with said retractable bars in said extended position, said retractable bars being positioned in a first plane adjacent each other, each of said retractable bars having a coplanar surface at a height to deliver said print media sheets to said binding device;

compiling a stack of said print media sheets on said sheet-receiving surface;

moving said stack of said print media sheets at least partially into an input opening of said binding device;

performing a binding operation on said stack of said print media sheets;

removing said stack of said print media sheets from said binding device; and retracting said retractable bars to said retracted position, forming an opening to allow said stack of said print media sheets to drop into a second plane, forming a finished stack of said print media sheets, said first plane being other than coplanar with said second plane and said first plane being relatively above said second plane.

15. The method according to claim 14, said binding device comprising a stapler.

16. The method according to claim 14, said retracting said retractable bars to said retracted position further comprising operating an actuator in a single direction causing said retractable bars to move to said retracted position.

17. The method according to claim 14, said retracting said retractable bars to said retracted position further comprising applying a force to links operatively connected to said retractable bars moving said retractable bars to said retracted position.

18. The method according to claim 14, said sheet-receiving surface further comprising bias elements comprising one of:

springs, bands, gas pistons, and arched elements.

19. The method according to claim 18, said bias elements biasing said retractable bars to said extended position.

20. The method according to claim 14, said sheet-receiving surface further comprising:

a first set of pivot arms, each arm of said first set of pivot arms having a first end, and having a second end opposite said first end, each arm of said first set of pivot arms being rotationally attached at said first end to said inboard member of each of said pair of retractable bars and rotationally attached at said second end to said mounting support; and a second set of pivot arms, each arm of said second set of pivot arms having a first end, and having a second end opposite said first end, each arm of said second set of pivot arms being rotationally attached at said first end to said outboard member of each of said pair of retractable bars and rotationally attached at said second end to said inboard member of each of said pair of retractable bars.

* * * * *